United States Patent [19]

Trudel

[11] 4,197,820

[45] Apr. 15, 1980

[54] METHOD AND APPARATUS FOR SUPPLYING FUEL TO AN INTERNAL COMBUSTION ENGINE

[76] Inventor: Roger Trudel, 1616 First Ave., Val Caron POM 3AO Ontario, Canada

[21] Appl. No.: 909,783

[22] Filed: May 26, 1978

Related U.S. Application Data

[63] Continuation of Ser. No. 724,708, Sep. 20, 1976.

[51] Int. Cl.[2] ..... F02B 69/00

[52] U.S. Cl. ..... 123/34 R; 123/34 A

[58] Field of Search ..... 123/34 A, 133, 34 R; 261/95, 104, 102

[56] References Cited

U.S. PATENT DOCUMENTS

| | | | |
|---|---|---|---|
| 528,882 | 11/1964 | Keller | 123/133 |
| 562,214 | 6/1896 | Burrows | 261/102 |
| 1,365,651 | 1/1921 | Beaumont et al. | 123/133 |
| 1,879,358 | 9/1932 | Lilly | 261/104 |
| 3,411,489 | 11/1968 | Kruger | 123/133 |
| 3,721,222 | 3/1973 | Shioya et al. | 123/117 A |
| 3,727,596 | 4/1973 | Panhard | 123/117 A |
| 3,802,406 | 4/1974 | Mennesson | 123/98 |
| 3,874,353 | 4/1975 | Woolridge | 123/133 |
| 4,009,698 | 3/1977 | Kato et al. | 123/117 A |

*Primary Examiner*—Charles J. Myhre
*Assistant Examiner*—R. A. Nelli

[57] ABSTRACT

A fuel supply system for an internal combustion engine wherein liquid fuel, as from an automobile gas tank, is supplied to a vapor chamber to maintain a predetermined liquid fuel level in the base of said chamber and in such chamber is transformed into vapor and eventually fed to the engine's intake manifold. Ambient air is admitted to the vapor chamber by an adjustable inlet valve and as the air is drawn through the chamber on its way to the engine it entrains the fuel vapors in the desired fuel-air mixture. The vaporizing of the liquid is increased by an absorbent splash assembly so supported in the vapor chamber that at least a part of such assembly normally engages the liquid fuel.

7 Claims, 6 Drawing Figures

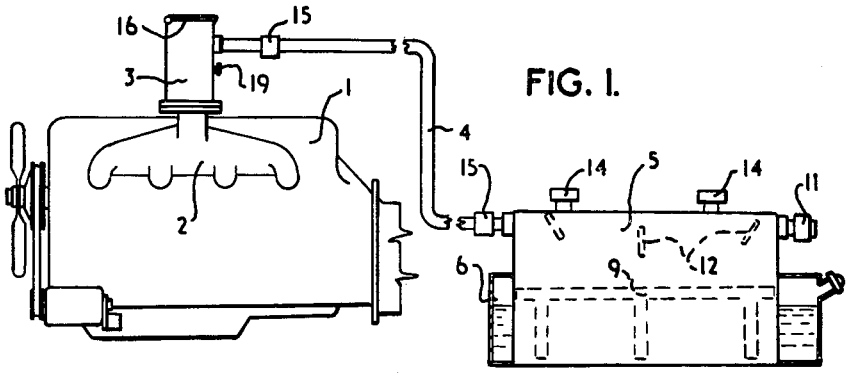
FIG. 1.
FIG. 2.
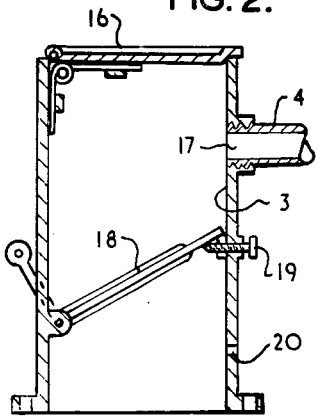
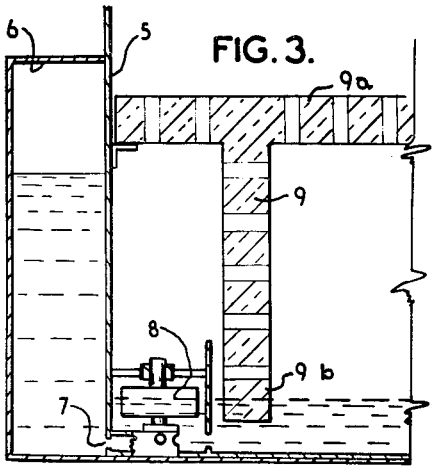
FIG. 3.
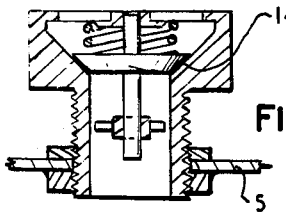
FIG. 5.
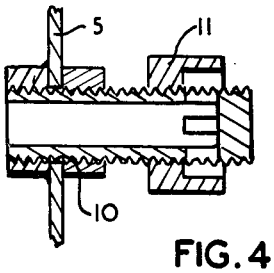
FIG. 4.
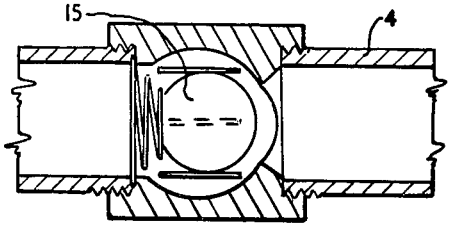
FIG. 6.

METHOD AND APPARATUS FOR SUPPLYING FUEL TO AN INTERNAL COMBUSTION ENGINE

This is a continuation of application Ser. No. 724,708 filed Sept. 20, 1976.

This invention relates to improvements in a fuel supply system and appertains particularly to a method of an apparatus for fueling an internal combustion engine.

It is a normal practice to feed an internal combustion engine with liquid fuel such as gasoline that is atomized and admixed with air in a carburetor connecting with the engine intake manifold. Various efforts have been made to reduce, separate and/or control fuel vapors forming in the gasoline tank of motor vehicles to lessen air pollution and lower fuel consumption.

The object of the present invention is to vaporize liquid fuel in a vapor chamber connected with the gasoline tank and to directly fuel the engine with such vapors admixed with ambient air admitted to the vapor chamber, instead of supplying liquid gasoline to a carburetor in the conventional way.

A further object is to maintain a predetermined depth of liquid fuel in a vapor chamber and to increase its vaporization by means of an absorbent splash assembly.

A further object of the invention is to provide a vaporizing and vapor storage chamber having an adjustable air inlet for ambient air with a conduit running from said chamber to the engine's intake manifold whereby the fuel-air mixture can be regulated.

A still further object of the invention is the provision of a fuel supply system for an internal combustion engine wherein a constant shallow level of liquid fuel is vaporized and the vapor stored in a vapor chamber and drawn directly to the engine's intake manifold under the suction of the engine entrained in a predetermined regulated flow of ambient air admitted to the vapor chamber.

To the accomplishment of these and related objects as shall become apparent as the description proceeds, the invention resides in the construction, combination and arrangement of parts as shall be hereinafter more fully described, illustrated in the accompanying drawings and pointed out in the claims hereunto appended.

BRIEF DESCRIPTION OF THE DRAWINGS:

The invention will be best understood and can be more clearly described when reference is had to the drawings forming a part of this disclosure wherein like characters indicate like parts throughout the several views.

In the drawings:

FIG. 1 is a schematic side elevation of an internal combustion engine equipped with the present fuel supply system;

FIG. 2 is an enlarged section of the throttle housing at the intake manifold end of the vapor conduit;

FIG. 3 is a sectional detail of the liquid level control for the vapor chamber;

FIG. 4 is a section of an adjustable air inlet valve;

FIG. 5 is a sectional detail of a pressure release valve; and

FIG. 6 is a sectional detail of a one-way vapor flow valve.

DETAILED DESCRIPTION OF THE INVENTION:

The embodiment of the invention illustrated in FIG. 1 shows a conventional automobile internal combustion engine 1 with an intake manifold 2 of the type normally served by a downdraft carburetor. Instead of a usual type liquid fuel fed carburetor a simple throttle housing 3 is connected to the manifold with the fuel supply conduit or pipeline 4 providing vapor fuel air mixture to the housing in response to the suction demand of the engine from a vapor chamber 5 positioned adjacent to and coupled with a liquid fuel gas tank 6.

The gasoline tank 6 provides liquid fuel to the vapor chamber 5 by means of a passage 7 controlled by a float valve 8 to maintain a shallow depth of liquid of approximately two inches in the bottom of the vapor chamber. A vaporizing assembly 9 of suitable absorbent, perforated or foam-like material is suspended in the vapor chamber 5 so that parts of it depend into and are kept moist by the shallow depth liquid and which, when the automobile is in motion, causes splashing of the liquid; thus increasing the vaporizing. The vaporizer has a horizontal body $9^a$ of an area comparable to that of the horizontal cross section of the chamber with spaced vertical wings $9^b$ normally engaging the liquid fuel but terminating above the bottom of the chamber.

In a side wall of the tank 5 near the top an opening 10 is an ambient air inlet fitted with a regulating valve 11 by means of which the volume of air permitted to enter the vapor chamber 5 is controlled. From an outlet port at a remote part of the chamber, such as the remote side wall near the top thereof the conduit or pipeline 4 runs to the throttle housing 3 connected to the engine's intake manifold 2. Between the air intake opening 10 and the outlet port from which the pipeline 4 extends, an arrangement of baffles 12 may be installed in the upper part of the vapor chamber 5 whereby a flow of air between the inlet and outlet ports entraining fuel vapors will agitate and tend to equalize any stratification of the vapors. Should excessive vapor pressure develop in the chamber 3, spring loaded poppet release valves 14 are provided in the top of the chamber.

Along the length of pipline 4 it is desirable to insert one or more one-way vapor flow valves 15.

The throttle housing 3 mounted atop the engine's intake manifold 2 has an open end with a spring loaded back-fire release cover 16 therefor which together with an adjacent one-way flow valve 15 in the pipeline reduces possibility of a vapor fuel line explosion. The pipeline 4 is connected with a port 17 in the wall of the housing 3 near the top and a throttle valve 18 is disposed between the feed port 17 and the manifold 2, the free side of the flap-type valve engaging an idler adjustment screw 19 for regulating engine idling speed. Furthermore, below the throttle valve 18, a vacuum advance outlet or bleed port 20 occurs in the housing wall. While any desired type of throttle valve and actuating linkage may be used, the flap-type valve 18 here shown is pivoted at the flat side of a semi-circular housing with the externally located control arm being engaged by a linkage that is spring actuated to close the valve against the adjustment idling screw under engine intake suction.

Throughout this specification the term vapor has been used to identify the gaseous fumes into which the liquid fuel is transformed in the vapor chamber but it should be understood that vapor and fumes are interchangeable to the extent that they are synonymous.

It is understood that various changes in the size, shape and arrangement of parts may be made to the form of invention herein shown and described, without departing from the spirit or scope of the invention.

What is claimed is:

1. A method for supplying fuel to an internal combustion engine by means of an enclosed vapor chamber connected to the engine manifold, said vapor chamber being internally divided into a lower fuel section and an upper vapor section by an intervening absorbent vaporizer which contacts liquid fuel provided to said lower fuel section which includes the steps of providing only liquid fuel to said fuel section below said vaporizer to maintain a shallow level of liquid fuel in said lower fuel section, storing fuel vapor formed from said liquid fuel by said vaporizer in the upper vapor section above said vaporizer, admitting only a controlled volume of ambient air through a single inlet at one side of said vapor chamber into said upper vapor section at a point adjacent the top thereof and remote from the surface of said absorbent vaporizer to prevent the air so admitted from becoming excessively saturated with fuel, causing said air to move completely across said upper vapor section above the vaporizer to a single remote outlet adjacent the top of the upper vapor section at a point on the side of said vapor chamber opposite said inlet and remote from the surface of said absorbent vaporizer, agitating the airstream substantially throughout the entire flow path across said upper vapor section between the point where said ambient air is admitted to said upper vapor section and the remote outlet to equalize any stratification of vapors, and conducting a vapor fuel-air mixture from the outlet to the engine intake manifold under the influence of the engine suction.

2. A fuel supply system for an internal combustion engine comprising in combination with an engine and its intake manifold:

(a) a source of liquid fuel, (b) a fuel vapor chamber including an enclosed housing, a vaporizer of absorbent material mounted within said enclosed housing and having a main body portion comparable in area to the horizontal cross-section of the enclosed housing, the main body portion being mounted to divide the interior of said enclosed housing into a lower fuel section and an upper vapor section above said fuel section, said vaporizer having portions in contact with liquid fuel in said lower fuel section when fuel is admitted thereto, fuel inlet means in the lower portion of said housing to supply only liquid fuel to said lower fuel section from said liquid fuel source, a single air inlet means formed on one side of said enclosed housing, said air inlet means being positioned adjacent the top of said upper vapor section at a point remote from the surface of said vaporizer main body portion to admit only air to said upper vapor section and to prevent the air so admitted from becoming excessively saturated with fuel, air outlet means formed on the side of said enclosed housing opposite said air inlet means, said air outlet means being positioned adjacent the top of said upper vapor section at a point remote from the surface of said vaporizer main body portion to convey air and entrained vapors from said upper vapor section, said air inlet and outlet means operating to create airflow completely across the extent of said upper vapor section, and baffle means mounted in the path of the airflow across said upper vapor section between said air inlet means and outlet means to agitate the air substantially throughout the entire flow path between said air inlet means and air outlet means to equalize any stratification from vapors, (c) a throttle assembly connected to control the flow of air and entrained vapors to said engine intake manifold, said throttle assembly including a throttle housing connected to the engine intake manifold and having an open end remote from the point of connection with said manifold, said open end being normally closed by a spring loaded backfire release cover means which opens under pressure to prevent a vapor fuel line explosion, and throttle valve means mounted within said throttle housing and operative to control the air and vapor flow to said manifold, and (d) connection means extending between said fuel vapor chamber and said throttle housing to convey air and entrained vapors from said outlet means to the interior of said throttle housing at a point above said throttle valve means.

3. The fuel supply system of claim 1 wherein said connection means includes a flow line connected between said vapor chamber and said throttle housing, said flowline including at least one one-way valve means to preclude an air-vapor back flow toward said vapor chamber.

4. The fuel supply system of claim 3 wherein said throttle valve means includes adjusting means to preset the idle control for said engine, said throttle housing being provided with a bleed port positioned between said throttle valve means and the connection to said engine intake manifold.

5. A fuel vapor chamber for a fuel supply system in an internal combustion engine having a fuel supply and an intake manifold comprising an enclosed housing, a vaporizer of absorbent material mounted within said enclosed housing and having a main body portion comparable in area to the horizontal cross-section of the enclosed housing, the main body portion being mounted to divide the interior of said enclosed housing into a lower fuel section and an upper vapor section, said vaporizer having portions in contact with liquid fuel in said lower fuel section when fuel is admitted thereto, fuel inlet means formed in the lower section of said enclosed housing to supply only liquid fuel to said lower fuel section from a fuel supply, an air inlet means formed in a first sidewall of said enclosed housing, said air inlet means being positioned adjacent the top of said upper vapor section at a point remote from the surface of said vaporizer main body portion to admit only air to said upper vapor section and to prevent the air so admitted from becoming excessively saturated with fuel, air outlet means formed in a second sidewall of said housing opposite said air inlet means, said air outlet means being positioned adjacent the top of said upper vapor section at a point remote from the surface of said vaporizer main body portion to convey air and entrained vapors from said upper vapor section, said air inlet and outlet means operating to create air flow completely across the extent of said vapor section, and a baffle means mounted in the path of the airflow across said upper vapor section between said air inlet means and air outlet means, said baffle means operating to agitate the air flowing between said air inlet means and air outlet means along substantially the entire flow path thereof to equalize any stratification of vapors.

6. The fuel vapor chamber of claim 15 which includes pressure responsive valve means formed in said housing above said vaporizer main body, said pressure responsive valve means operating to release pressure from said upper vapor section should excessive vapor pressure develop within said housing.

7. The fuel vapor chamber of claim 6 wherein said fuel inlet means includes float valve means operative to maintain a shallow level of liquid fuel in said lower fuel section, said vaporizer including spaced, perforated vertical wings extending downwardly from said main body portion into the liquid fuel in said lower fuel section but terminating above the bottom of said lower fuel section, and said air inlet means includes regulating valve means to regulate the volume of air admitted to said upper vapor section.

* * * * *